US008187113B2

(12) United States Patent
Lim

(10) Patent No.: US 8,187,113 B2
(45) Date of Patent: May 29, 2012

(54) APPARATUS FOR IDENTIFYING POINT OF HOLE PIN IN THE GOLF COURSE AND REGISTRATING METHOD THEREOF

(76) Inventor: Seong-Kyu Lim, Daegu (KR)

( * ) Notice: Subject to any disclaimer, the term of this patent is extended or adjusted under 35 U.S.C. 154(b) by 81 days.

(21) Appl. No.: 12/676,509

(22) PCT Filed: Sep. 5, 2008

(86) PCT No.: PCT/KR2008/005255

§ 371 (c)(1),
(2), (4) Date: Mar. 4, 2010

(87) PCT Pub. No.: WO2009/038299

PCT Pub. Date: Mar. 26, 2009

(65) Prior Publication Data

US 2010/0197420 A1 Aug. 5, 2010

(30) Foreign Application Priority Data

Sep. 20, 2007 (KR) ..... 10-2007-0096039

(51) Int. Cl.
*A63B 57/00* (2006.01)

(52) U.S. Cl. ..... 473/176; 116/173

(58) Field of Classification Search ..... 473/174–179, 473/168–170, 150–155, 570; 362/153.2, 362/562; 40/541; 116/174
See application file for complete search history.

(56) References Cited

U.S. PATENT DOCUMENTS 3,104,879 A * 9/1963 Jetton ..... 473/153
5,265,875 A * 11/1993 Fitzgerald ..... 473/169
5,445,373 A * 8/1995 Franks ..... 473/409
6,099,139 A * 8/2000 Lapensee ..... 362/153.1
6,699,137 B2 * 3/2004 Szymanski ..... 473/169
7,594,859 B2 * 9/2009 Mullen ..... 473/176
(Continued)

FOREIGN PATENT DOCUMENTS

JP 3054972 10/1998
(Continued)

OTHER PUBLICATIONS

International Search Report mailed Oct. 31, 2008 for PCT/KR2008/005255, citing the above references.

*Primary Examiner* — Mark Graham
(74) *Attorney, Agent, or Firm* — Lowe Hauptman Ham & Berner, LLP

(57) ABSTRACT

The present invention relates to an apparatus for identifying a pin position on a golf course. The apparatus includes light-emitting means coupled to a pin pole, configured to identify a pin position, and including a wireless transmit/receive portion and a unique ID, and a remote control unit remotely controlling lighting and lights-out of the light-emitting means in a wireless manner. The remote control unit includes a wireless transmit/receive portion, a control object-setting portion selecting light-emitting means to be controlled, an execution button instructing the lighting and lights-out of the light-emitting means, and a remote controller which controls a unique ID of the light-emitting means to be controlled to be registered with internal memory by matching the unique ID to a remote control object ID of the control object-setting portion, and wirelessly transmits a lighting and lights-out command to light-emitting means having a unique ID, which matches to the registered remote control object ID, through the wireless transmit/receive portion when an execution button is pressed.

3 Claims, 6 Drawing Sheets

U.S. PATENT DOCUMENTS

| | | | | |
|---|---|---|---|---|
| 2004/0083633 | A1* | 5/2004 | Mueller | 40/541 |
| 2004/0203410 | A1* | 10/2004 | Kim | 455/66.1 |
| 2004/0220001 | A1* | 11/2004 | Oister et al. | 473/570 |
| 2010/0160057 | A1* | 6/2010 | Willett | 473/176 |

FOREIGN PATENT DOCUMENTS

| | | |
|---|---|---|
| JP | 2001286591 | 10/2001 |
| JP | 2003345276 | 12/2003 |
| KR | 1020010003029 | 1/2001 |

* cited by examiner

[Fig. 1]
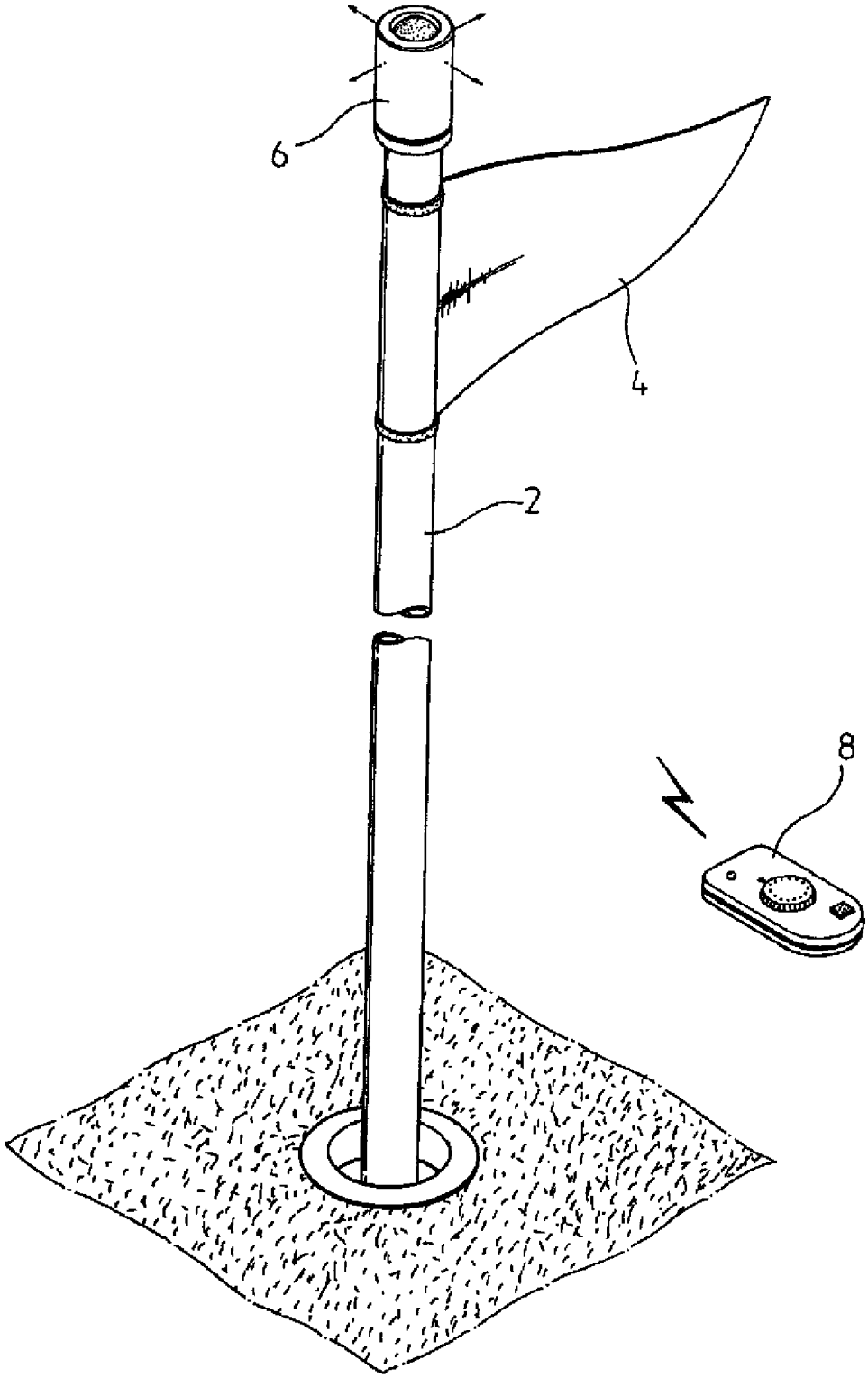

[Fig. 2]
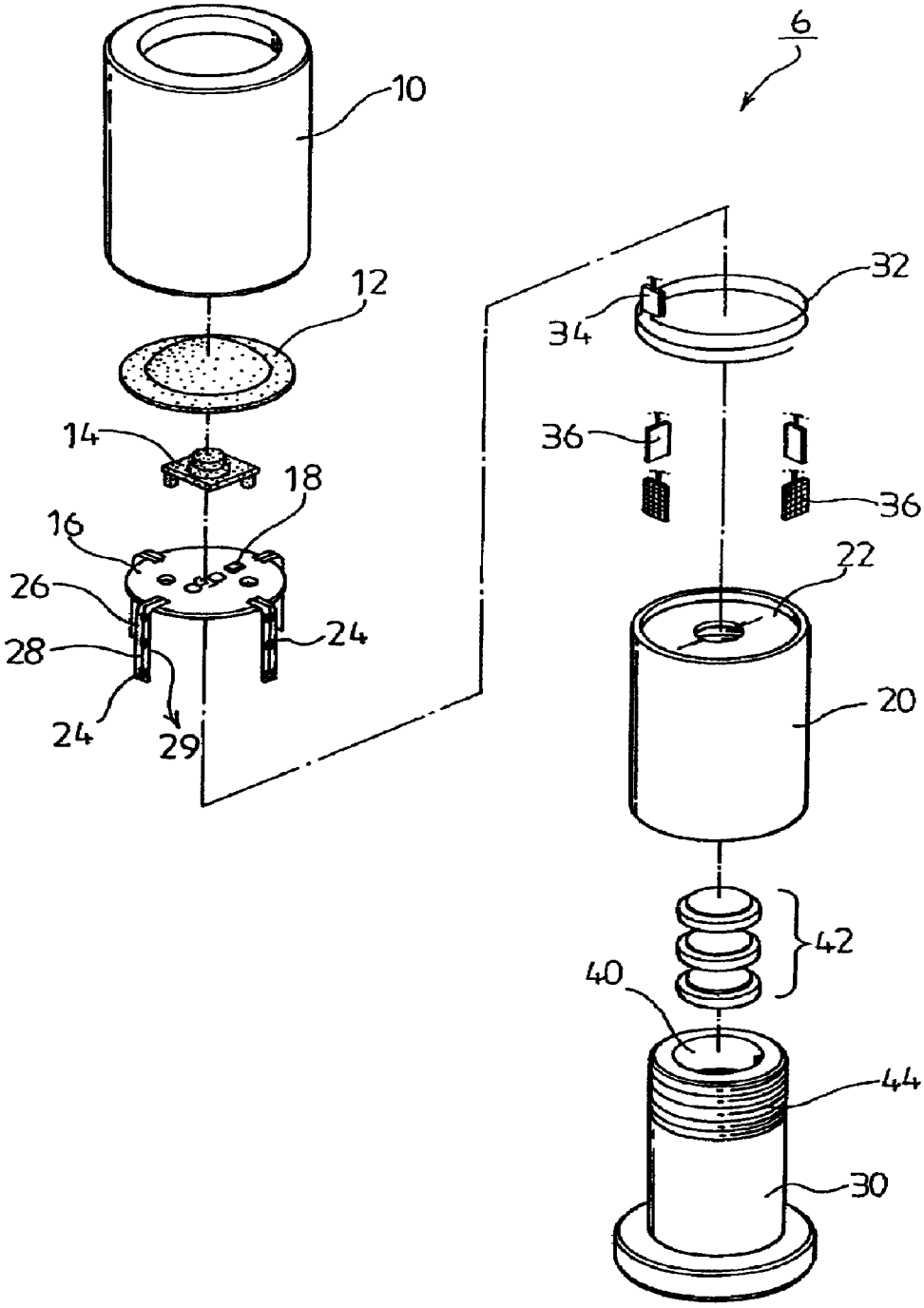

[Fig. 3]
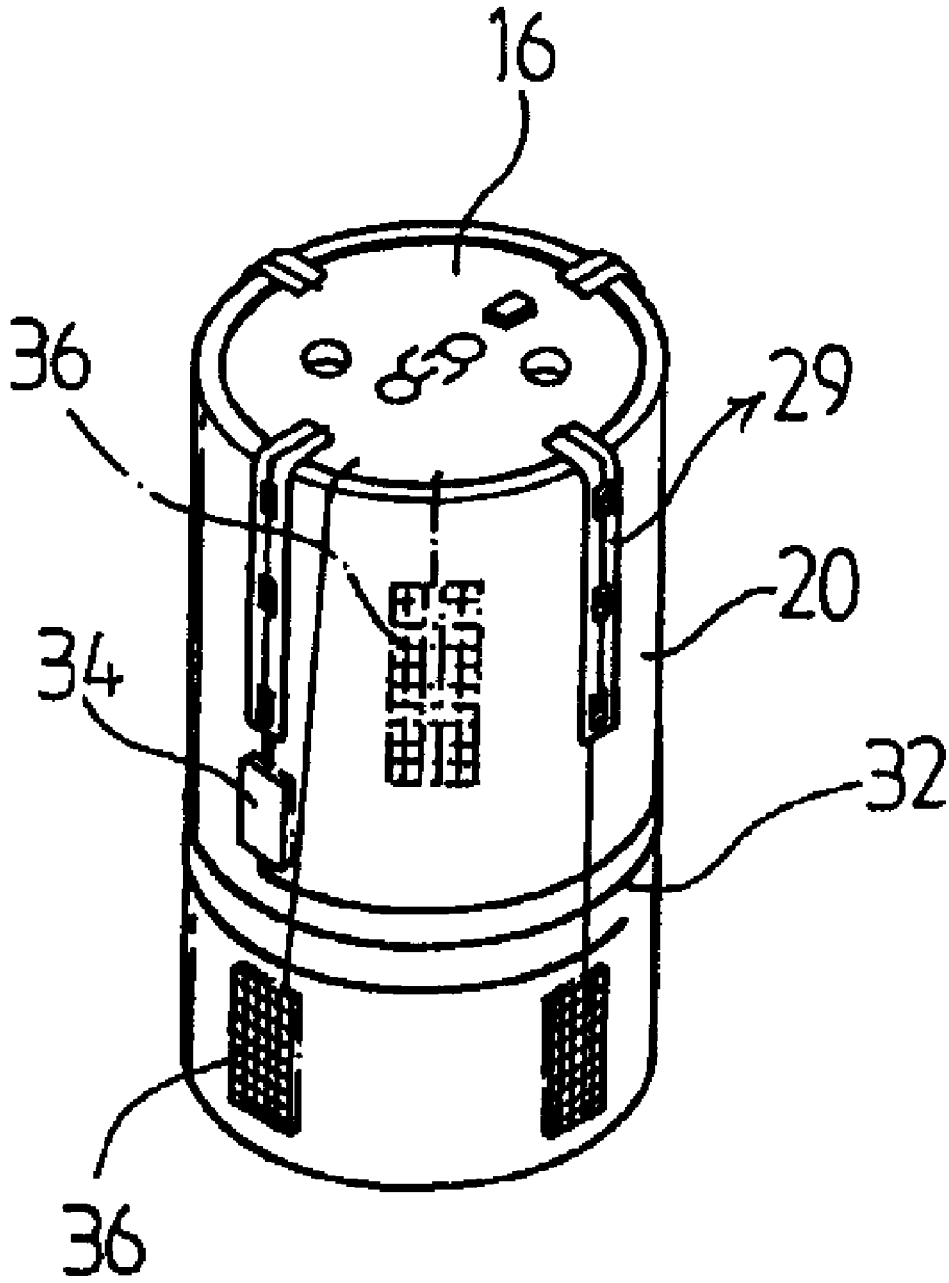

[Fig. 4]
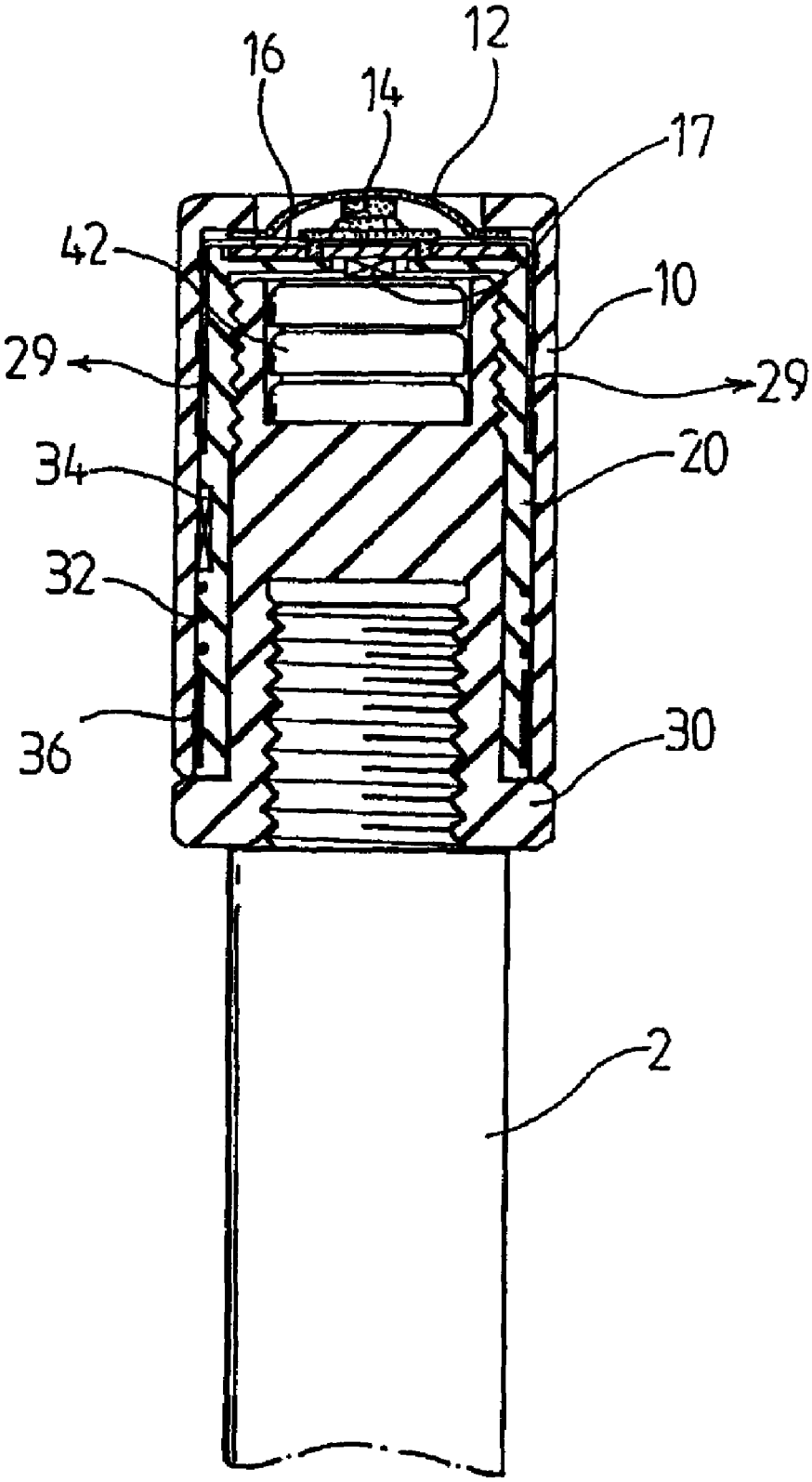

[Fig. 5]
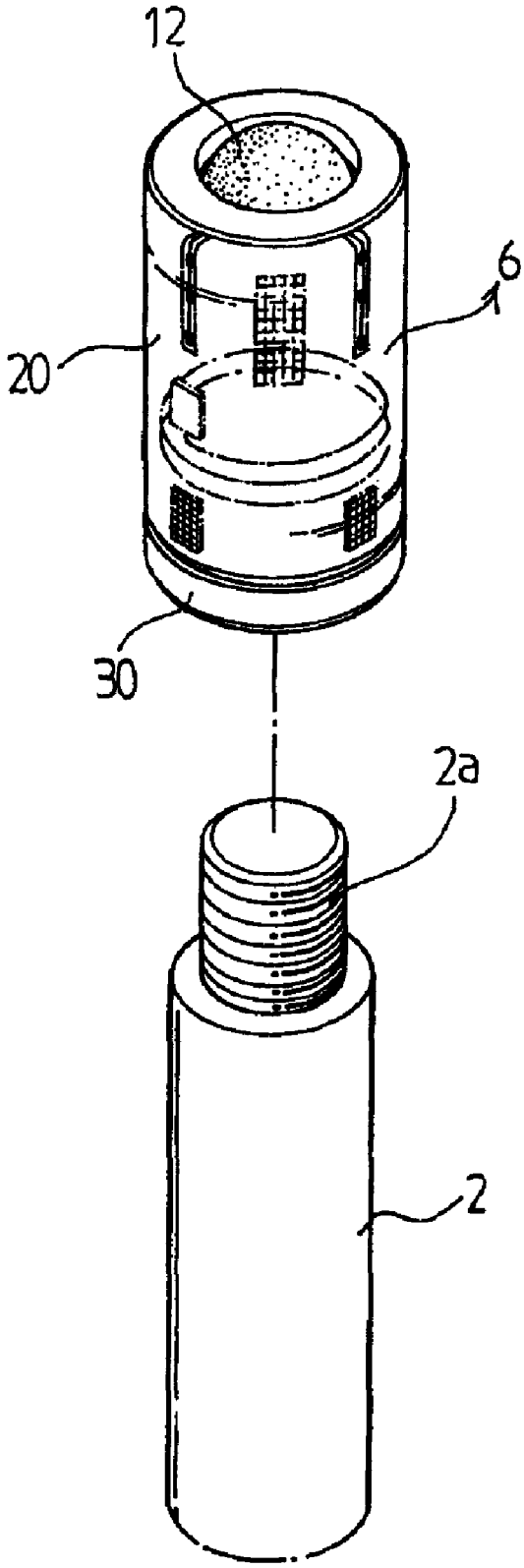

[Fig. 6]
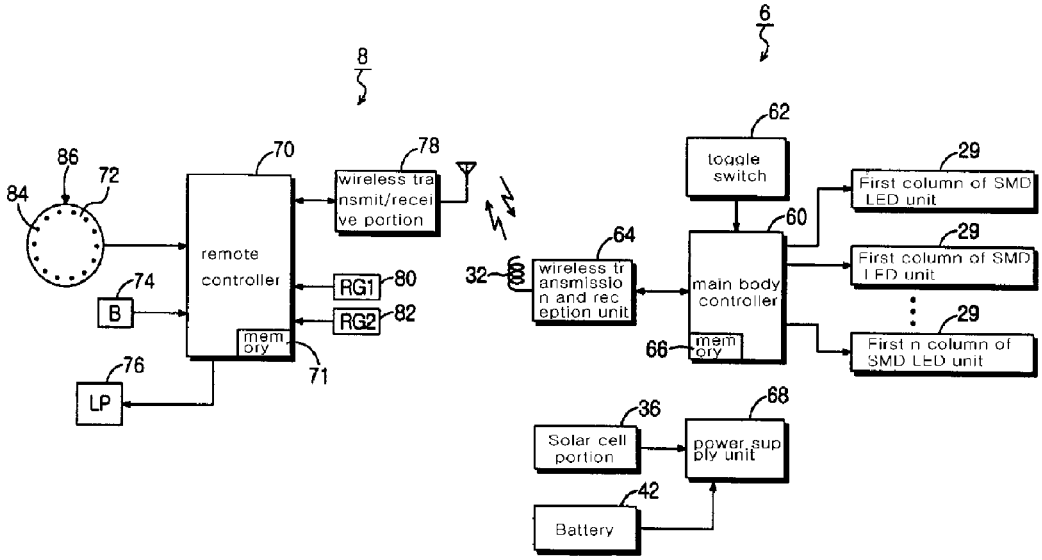
[Fig. 7]
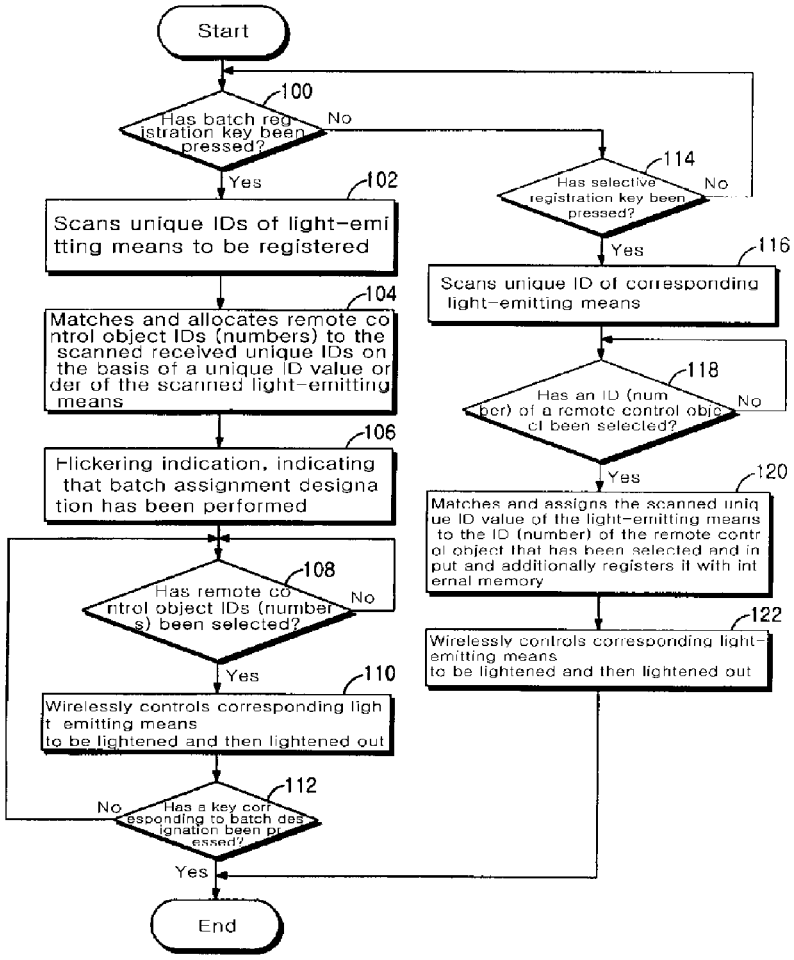

APPARATUS FOR IDENTIFYING POINT OF HOLE PIN IN THE GOLF COURSE AND REGISTRATING METHOD THEREOF

CROSS REFERENCE TO RELATED APPLICATION

This application claims the priority of Korean Patent Application No. 10-2007-0096039, filed on Sep. 20, 2007 in the KIPO (Korean Intellectual Property Office), the disclosure of which are incorporated herein in their entirety by reference. Further, this application is the National Phase application of International Application No. PCT/KR2008/005255, filed Sep. 5, 2008, which designates the United States and was published in English. Each of these applications is hereby incorporated by reference in their entirety into the present application.

TECHNICAL FIELD

The present invention relates to golf equipment, and more particularly, to an apparatus for identifying a pin position on a golf course, enabling easily identifying a pin position on a golf course, and a method of registering light-emitting means in the same.

BACKGROUND ART

In general, a golf course includes a total of 18 holes; four long holes, ten middle holes, and four short holes. In the short hole, a distance between the tee box and the hole cup of the green is generally 229 meters or less. In the middle hole, a distance between the tee box and the hole cup of the green is generally 230 to 430 meters. In the long hole, a distance between the tee box and the hole cup of the green is generally 431 meters or more.

Most golfers can place their balls on the green by hitting only one shots from the tee box in the case of the short hole, but cannot send the balls 300 meters or more from the tee box in the case of the middle hole or the long hole. Golfers hit their shots from the tee box while keeping a reduction in error in mind. Thus, an average tee shot distance of even a professional golfer is at most 270 to 280 meters. An amateur golfer comparable to a professional golfer can send his ball up to 250 to 270 meters from the tee box.

When a golfer hits a next shot (a second or third shot) after hitting a tee shot in the middle hole or the long hole or hits a tee shot (or a second shot) in the short hole, the golfer has to check a flag at the top of a pin pole fixed in the hole cup of the green from a long distance of one hundred and several tens of meters to two hundred and several tens of meters and hit a next shot.

When a pin flag flutters in the wind, it would help identifying the location of the hole pin. However, when the pin flag not flutters, it would be very difficult to find the location of the hole pin. Further, in the case of a golfer who has weak eyesight due to presbyopia, etc. or when it is not easy to distinguish a pin flag from surrounding colors due to a change in the season, it would be very difficult to identify the location of a hole pin due to the geographical influence of fairway.

Due to the reasons, a golfer generally asks a caddie where the direction it. The caddie gives the golfer a vague and rough direction (for example, a telegraph pole or a light direction) since there is no clear milestone. Consequently, the golfer has to inevitably hit a shot with a little feeling of uneasiness.

Accordingly, there is a need for an apparatus that enables a golfer to identify the location of a hole pin more easily and conveniently.

Further, in the case in which the putting green is not seen since there is a hill between a location where a shot is hit and the putting green or there is fairway tilted from the left to the right, a guide pin having a flag is placed at an appropriate location of the fairway in order to indicate the direction. However, there is a case where even the guide pin is not seen clearly like the hole pin. Accordingly, there is a need for an apparatus for identifying the guide pin.

DISCLOSURE OF INVENTION

Technical Problem

Accordingly, the present invention has been made in view of the above problems occurring in the prior art, and an object of the present invention is to provide an apparatus for identifying a pin position on a golf course, enabling a pin position on a golf course to be easily identified, and a method of registering light-emitting means in the same.

Technical Solution

To achieve the above object, the present invention provides an apparatus for identifying a pin position on a golf course includes light-emitting means coupled to an upper end of a pin pole and configured to identify a pin position, the light-emitting means including a wireless transmit/receive portion and a unique ID, and a remote control unit that remotely controls lighting and lights-out of the light-emitting means for identifying the pin position in a wireless manner. The remote control unit includes a wireless transmit/receive portion, a control object-setting portion that selects light-emitting means to be controlled, an execution button that instructs the lighting and lights-out of the light-emitting means, and a remote controller which controls a unique ID of the light-emitting means to be controlled, which is wirelessly received through scanning in a registration mode, to be registered with internal memory by matching the unique ID to a remote control object ID of the control object-setting portion, and wirelessly transmits a lighting and lights-out command to light-emitting means having a unique ID, which matches to the remote control object ID registered with the internal memory, through the wireless transmit/receive portion when an execution button is pressed.

Further, the present invention provides a method of registering light-emitting means in an apparatus for identifying a pin position on a golf course, wherein the apparatus includes light-emitting means coupled to an upper end of a pin pole and configured to identify a pin position, the light-emitting means having a wireless transmit/receive portion and a unique ID, and a remote control unit that remotely controls lighting and lights-out of the light-emitting means for identifying the pin position in a wireless manner. The method includes the steps of scanning a unique ID of the light-emitting means through a wireless transmission and reception when a registration key of the remote control unit is pressed, controlling the scanned unique ID of the light-emitting means to be registered with internal memory by matching the scanned unique ID to a remote control object ID selected by a control object-setting portion of the remote control unit, and wirelessly controlling light-emitting means, corresponding to the registered remote control object ID, to be lightened and lightened out.

Advantageous Effects

In accordance with the present invention, the light-emitting means is mounted in a pin pole on a golf course, and lighting and lights-out of the light-emitting means is controlled using the remote controller. Accordingly, there are advantages in that a golfer can identify a pin position, such as a hole pin or a guide pin, easily and hit a shot comfortably.

BRIEF DESCRIPTION OF THE DRAWINGS

Further objects and advantages of the invention can be more fully understood from the following detailed description taken in conjunction with the accompanying drawings in which:

FIG. 1 is a schematic perspective view of an apparatus for identifying a pin position on a golf course in accordance with an embodiment of the present invention;

FIG. 2 is an exploded perspective view of light-emitting means for identifying a pin position, which is coupled to the top end of a pin pole shown in FIG. 1;

FIG. 3 is an exploded perspective view of a part of the light-emitting means;

FIG. 4 is an assembled sectional view of the light-emitting means;

FIG. 5 is a perspective view of the light-emitting means separated from the pin pole;

FIG. 6 is a circuit diagram of the apparatus for identifying a pin position on a golf course in accordance with an embodiment of the present invention; and FIG. 7 is a flowchart illustrating a method of registering and controlling the light-emitting means in a remote controller.

DESCRIPTION OF REFERENCE NUMERALS OF PRINCIPAL ELEMENTS IN THE DRAWINGS

| | |
|---|---|
| 2: | pin pole |
| 4: | flag |
| 6: | light-emitting means for identifying pin position |
| 8: | remote controller |
| 10: | housing |
| 20: | fixing member |
| 24: | surface mounted device light emission diode |
| 30: | base |
| 36: | solar cell portion |

MODE FOR THE INVENTION

The present invention will now be described in detail in connection with specific embodiments with reference to the accompanying drawings.

FIG. 1 is a schematic perspective view of an apparatus for identifying a pin position on a golf course in accordance with an embodiment of the present invention. FIG. 2 is an exploded perspective view of light-emitting means for identifying a pin position (hereinafter referred to as a 'light-emitting means') 6, which is coupled to the top end of a pin pole 2 shown in FIG. 1. FIG. 3 is an exploded perspective view of a part of the light-emitting means 6.

Further, FIG. 4 is an assembled sectional view of the light-emitting means 6. FIG. 5 is a perspective view of the light-emitting means 6 separated from the pin pole 2. FIG. 6 is a circuit diagram of the apparatus for identifying a pin position on a golf course in accordance with an embodiment of the present invention.

The apparatus for identifying a pin position on a golf course in accordance with an embodiment of the present invention includes, as shown in FIG. 1, the light-emitting means 6 coupled to the top end of the pin pole 2 and a remote control unit 8, which remotely controls lighting and lights-out of the light-emitting means 6 in a wireless manner.

The pin pole 2 is a pole of 2.1 meters (7 feet) or more) in length, which is used as a hole pin or guide pin on a golf course, and has a flag 4 hung at the top. In the present invention, a screw portion 2*a* is formed at the top of the pin pole 2, enabling the light-emitting means 6 constructed as shown in FIGS. 2 to 5 to be screwed.

The light-emitting means 6 according to an embodiment of the present invention is constructed to perform lighting emission or flickering emission at high brightness with various colors (such as red, blue, orange and white) when being switched on wirelessly by a push button switch or the remote control unit 8, which is installed in a main body, at a remote place.

The light-emitting means 6 largely includes a housing 10, a fixing member 20 and a base 30.

The housing 10 is made of transparent synthetic material and has a pipe shape having a hole formed therein. A button cover 12 is closely adhered to the bottom of the housing 10, helping a user to press a button using a finger, a thin tool, etc. The button cover 12 is made of soft material such as rubber.

The fixing member 20 is a member in which, after the member is inserted into the housing 10, components are mounted in the member, fused and combined, and then integrated with the housing 10. In an upper seating surface 22 of the fixing member 20 is seated a printed circuit board 16. A control chip 18 is mounted in the printed circuit board 16 in a bare chip form. A push button 14 is seated and fixed on the printed circuit board 16.

The printed circuit board 16 of a circular shape is a thin film board and has a circuit pattern formed thereon. The control chip 18 of the bare chip form is formed on the printed circuit board 16. Further, a circuit for wireless transmission and reception, a circuit for power supply, and so on are formed on the printed circuit board 16. The control chip 18 controls a surface mounted device light emission diode (hereinafter referred to as 'S MD LED') 24 to perform lighting emission or flickering emission with various colors. A main body controller 60 of FIG. 6 can be implemented in the form of the control chip 18.

Plural columns of flexible printed circuit cables 26 are connected to circuit pattern lines of the printed circuit board 16. The flexible printed circuit cables 26 are constructed to electrically connect the control chip 18 and the SMD LEDs 24 through conductive film lines 28 of the flexible printed circuit cables 26 and the circuit pattern lines of the printed circuit board 16. Reference numeral '29' denotes each column of a SMD LED unit, comprising the flexible printed circuit cable 26, the conductive film line 28, and the SMD LEDs 24.

The flexible printed circuit cables 26 are connected in plural numbers in a radial direction from an outer circumference of the printed circuit board 16 and hung down. A pair of the SMD LEDs 24 is arranged on each flexible printed circuit cable 26 at long intervals. Plural pairs of the SMD LEDs 24 are electrically connected in parallel. Each of the SMD LEDs 24 is preferably implement to emit light at high brightness of 10 to 30 candelas [cd] with various colors.

Further, the printed circuit board 16 is electrically connected to an antenna circuit unit 34 having a loop type antenna 32 and is also electrically connected to a solar cell portion 36 having a plurality of solar cell plates.

When the loop type antenna 32 is inserted into the fixing member 20 and the printed circuit board 16 is mounted in the upper seating surface 22 of the fixing member 20, the plural columns of SMD LEDs units 29, the solar cell portion 36, the loop type antenna 32, and the antenna circuit unit 34 are positioned on an outer cylindrical surface of the fixing member 20, as in the example shown in FIG. 3. When the thickness or size of the solar cell portion 36 or the loop type antenna 32 and the antenna circuit unit 34 is large to the extent that they may hinder the insertion of the housing 10 and the fixing member 20, it is necessary to form a displacement groove unit in which corresponding components will be placed in the outer cylindrical surface of the fixing member 20. Further, although FIG. 3 shows an example in which the solar cell portion 36 is located at the bottom of the outer cylindrical surface of the fixing member 20, it should be understood that the solar cell portion 36 cam also be located between the respective columns of the SMD LED units 29. Here, a lower electrode end (17 of FIG. 4) of the printed circuit board 16 is exposed downwardly through a through hole of the upper seating surface 22 of the fixing member 20.

In this state, when the fixing member 20 is inserted into the housing 10 and then experiences ultrasonic or thermal fusion, the fixing member 20 and the housing 10 are integrated as shown in the sectional view of FIG. 4. Accordingly, the push button 14 and the printed circuit board 16 are seated in the upper seating surface 22 of the fixing member 20 and fixed thereto and maintain a sealing state.

Meanwhile, the base 30 having a battery accommodation groove 40 is inserted into the fixing member 20 and then screwed thereto. Batteries 42, that is, primary (consuming) or secondary (charging/discharging) cells are accommodated in the battery accommodation groove 40. The batteries 42 can be implemented to be responsible for a battery unit of the solar cell portion 36. As an alternative example, a battery unit for additional solar cells can be formed in the battery accommodation groove 40 or the printed circuit board 16.

In the base 30, reference numeral '44' denotes the screw portion.

When the batteries 42 are accommodated in the battery accommodation groove 40 of the base 30 and then screwed to the fixing member 20 integrated with the housing 10, the light-emitting means 6 of the present invention is assembled and completed.

The above light-emitting means 6 for identifying a pin position is coupled to the top end of the pin pole 2, such as a hole pin or a guide pin pinned in a corresponding field on a golf course, as shown in FIG. 1.

A circuit configuration of the above-described light-emitting means 6 includes, as shown in FIG. 6, a main body controller 60, a toggle switch 62, a wireless transmission and reception unit 64 having the loop type antenna 32, a power supply unit 68 having the solar cell portion 36 and the batteries 42, and first to nth columns of the SMD LED units 29.

The power supply unit 68 supplies DC power, which is necessary for each component of the light-emitting means 6, to the each component using electric power generated from the solar cell portion 36 or the batteries 42.

The toggle switch 62 functions as a connection switch, which alternately performs lighting and lights-out whenever a user presses the push button 14. The main body controller 60 stores a light emission control cycle and a lighting or flickering control cycle of each column of the SMD LED units 29 and an unique identifier (ID) of corresponding light-emitting means 6 in internal memory 66. Further, the main body controller 60 controls light emission of each column of the SMD LED units 29 according to a preset program when the toggle switch 62 is turned on and also controls lighting and lights-out of the SMD LED units 29 according to remote wireless control of a user using the remote control unit 8.

Referring back to FIG. 1, the remote control unit 8 functions to remotely control lighting and lights-out of a plurality of the light-emitting means 6 coupled to the top end of the pin pole 2 on a golf course.

The remote control unit 8 includes, as shown in FIG. 6, a remote controller 70, a control object-setting portion 72 such as a jog shuttle, an execution button 74, a status indication lamp 76, a batch registration key 80, a select registration key 82, and a wireless transmit/receive portion 78.

The remote controller 70 controls an overall operation of the remote control unit 8. In particular, in accordance with an embodiment of the present invention, the remote controller 70 controls the light-emitting means 6 (that is, a control object) by matching a unique ID of the light-emitting means 6, which is wirelessly received through scanning in a registration mode, to an ID of the control object-setting portion 72, which is a remote control object, and then storing matched IDs in the internal memory 71. Thereafter, the remote controller 70 controls lighting and lights-out of corresponding light-emitting means 6 by wirelessly transmitting lighting and lights-out commands to the light-emitting means 6 having a unique ID, which matches an ID (number) of a remote control object that has been registered with the internal memory 71, through the wireless transmit/receive portion 78 when the execution button 74 is pressed. The wireless transmit/receive portion 78 is a block that transmits and receives RF signals to and from the plurality of light-emitting means 6 at a commercial frequency band.

The control object-setting portion 72 can be constructed, for example, like a jog shuttle as in FIG. 6 and functions to select the light-emitting means 6, that is, a control object.

In the example of FIG. 6, IDs 84, including pinhole number, can be engraved in the outer circumference of the jog shuttle of the control object-setting portion 72 in a concentric form. For example, a corresponding control object ID (number) of a remote control object can be selected by matching the ID 84 of the jog shuttle to a reference point 86 formed on the jog shuttle.

The execution button 74 is a button that instructs lighting and lights-out of the light-emitting means 6 and is operated under the control of the remote controller 70.

In an embodiment of the present invention, a remote controller user can perform lighting and lights-out of the entire light-emitting means 6 arbitrarily, which is mounted in the pin poles 2 pinned in a golf course, using the remote control unit 8. To this end, the unique IDs of the light-emitting means 6 mounted in the pin poles 2 on a golf course must be previously registered with the remote control unit 8.

This previous registration of the unique IDs of the light-emitting means 6 with the remote control unit 8 is performed by a remote controller user in the registration mode using the batch registration key 80 or the select registration key 82 of the remote control unit 8. The batch registration key 80 or the select registration key 82 is rarely used other than when IDs of the light-emitting means 6 are registered, and therefore can be installed on the side, etc. of the remote control unit 8 and can be implemented in a dip switch type.

When a remote controller user presses the batch registration key 80 or the select registration key 82 of the remote control unit 8, the remote controller 70 registers the light-emitting means 6 with the remote control unit 8 in the registration mode using a control program as shown in FIG. 7. That is, a unique ID of each light-emitting means 6, that is, a control object matches to an ID (number) of a remote control object of the remote control unit 8 and is then registered.

FIG. 7 is a flowchart illustrating a method of registering and controlling the light-emitting means in the remote controller 70.

Hereinafter, a procedure of registering the light-emitting means 6 of the present invention with the remote control unit 8 is described in detail with reference to FIG. 7.

A user, such as a caddie, can register the entire light-emitting means 6, which will be installed in the pin poles 2 on a golf course, batchly or selectively. The batch registration method is a preferred method that can be adopted when first installing or batchly reinstalling the light-emitting means 6 in the pin poles 2 on a golf course, and the selective registration method is a method that can be adopted when several light-emitting means 6 is out of order or when additional light-emitting means 6 needs to be installed.

First, the method of batchly registering the light-emitting means 6 with the remote control unit 8 is described.

When a user, such as a caddie, puts aside the entire light-emitting means 6 to be installed on a golf course and presses the batch registration key 80 of the remote control unit 8, the remote controller 70 recognizes such pressing (step 100 of FIG. 7) and scans unique IDs of the light-emitting means 6 (step 102 of FIG. 7).

That is, the remote controller 70 transmits wireless signals corresponding to scan requests for unique IDs of the light-emitting means through the wireless transmit/receive portion 78 in a wireless manner. The main body controller 60 of each light-emitting means 6 reads a unique ID mapped to the internal memory 66 in response to the scan request for the unique ID of the light-emitting means, which has been received through the loop type antenna 32 and the wireless transmit/receive portion 64, and transmits the scanned unique ID to the remote control unit 8 wirelessly.

The remote controller 70 of the remote control unit 8 collects the unique IDs, which have been scanned in step 102 of FIG. 7 and received from the entire light-emitting means 6, matches and allocates IDs (numbers) of remote control objects to the scanned received unique IDs on the basis of a unique ID value order, and then registers matched IDs (numbers) with the internal memory 71 (step 104 of FIG. 7).

For example, when the light-emitting means 6 as many as 18 pin holes exists, the remote controller 70 can scan respective unique IDs of the light-emitting means 6 and assign numbers 1 to 18 (IDs of remote control objects), which are engraved in the jog shuttle (that is, an example of the control object-setting portion 72) in order of lower unique ID value.

Thereafter, the remote controller 70 performs flickering indication, indicating that batch assignment designation has been performed, through the status indication lamp 76 (step 106 of FIG. 7).

However, so far, the user does not know which numbers (IDs of remote control objects) have been assigned to the light-emitting means 6. The user can know the numbers by rotating the engraved IDs of the control object-setting portion 72 one by one.

More specifically, when the user selects an ID (number) of a remote control object using the control object-setting portion 72, that is, when the user matches the engraved ID number 84 to the reference point 86 by rotating the IDs of the jog shuttle one by one in the example as shown in FIG. 6, the remote controller 70 determines that the ID of the jog shuttle has been selected (step 108 of FIG. 7) and proceeds to step 110 of FIG. 7.

In step 110 of FIG. 7, the remote controller 70 performs wireless control to light and then light out the corresponding light-emitting means 6. For example, if 'NO. 1' of the ID (number) 84, that is, the remote control object engraved in the jog shuttle being the control object-setting portion 72 matches to the reference point 86, the remote controller 70 reads a unique ID of the corresponding light-emitting means 6, which matches to the No. 1 and has been stored in the internal memory 71, from the internal memory 71. Next, the remote controller 70 transmits a control command, which lights and then lights out the corresponding light-emitting means, to the corresponding light-emitting means 6 along with the unique ID of the light-emitting means in a wireless manner.

Accordingly, the main body controller 60 of the light-emitting means 6 corresponding to the unique ID lights each column of the SMD LED units 29 for a specific period of time and then lights out the SMD LED units 29. Therefore, the user can know which light-emitting means 6 corresponds to the No. 1 and give an identification mark on the light-emitting means 6 by attaching a label to the light-emitting means 6 or writing letters in the light-emitting means 6 in order to easily identify it.

The user can give identification marks to the entire light-emitting means 6 by repeatedly performing the steps (108 and 110 of FIG. 7) using the remote controller 70 while rotating the jog shuttle, that is, the control object-setting portion 72. After the identification marks are given to the entire light-emitting means 6, the user presses a key corresponding to batch designation, for example, the execution key. When the user presses a key corresponding to batch designation, the remote controller 70 recognizes such pressing (step 112 of FIG. 7) and finishes the process.

Next, the method of selectively registering several light-emitting means 6 with the remote control unit 8 is described.

When a user, such as a caddie, put aside the light-emitting means 6, which will be additionally installed or installed again in a golf course, one by one and presses the select registration key 82 of the remote control unit 8, the remote controller 70 recognizes such pressing (step 114 of FIG. 7) and then proceeds step (116 of FIG. 7) in which unique IDs of the corresponding light-emitting means 6 are scanned.

Thereafter, when the user selects an ID (number) of a remote control object using the control object-setting portion 72, that is, when the user matches a desired ID (number) 84 of a remote control object to the reference point 86 by rotating the jog shuttle in the example as shown in FIG. 6, the remote controller 70 of the remote control unit 8 determines such matching (step 118 of FIG. 7) and then proceeds a step (120 of FIG. 7).

In step (120 of FIG. 7), the remote controller 70 matches and assigns unique ID values, which have been received from the corresponding light-emitting means 6, to the IDs (numbers) of the remote control objects, which have been selected and input, and additionally registers them with the internal memory 71.

After the step (120 of FIG. 7) is performed, the remote controller 70 wirelessly controls the corresponding light-emitting means 6 to be lightened and then lightened out (step 122 of FIG. 7). Thus, the corresponding light-emitting means 6 lights each column of the SMD LED units 29 for a specific period of time and then lights out the SMD LED units 29. Accordingly, the user can check that the corresponding light-emitting means 6 has been registered.

A user, such as a caddie, can install the light-emitting means 6, which has been registered through the process of FIG. 7, in a desired pin pole 2 based on a desired identification mark.

When the registered light-emitting means 6 is installed in the entire pin poles 2 on a golf course as described above, it becomes as if pin positions on a golf course are all registered with the remote control unit 8. A user can light and light out the light-emitting means 6 of a desired pin according to a request of a playing golfer.

In the case in which it is necessary to prepare a plurality of the remote control units 8 registered in order to control the light-emitting means 6 as described above, the remote control units 8 can be prepared using a method of copying registration information of the remote control unit 8. A corresponding copy program can also be mapped to the internal memory 71 of the remote controller 70. For example, if registration information is copied in the state in which one remote control unit 8, which has been first registered, is set to a master and a plurality of the remote control units 8, which has not been registered, is set to a slave, the corresponding registration information can be transmitted from the master to the slaves through the wireless transmit/receive portion in a wireless manner and stored in the internal memory 71.

Although the detailed embodiment of the present invention has been disclosed, various modifications are possible without departing from the scope of the invention. Accordingly, it is to be understood that the invention is not limited to the disclosed embodiment, but should be defined by equivalent arrangements the appended claims.

INDUSTRIAL APPLICABILITY

The present invention can be used for golf articles.

The invention claimed is:

1. An apparatus for identifying a pin position on a golf course, comprising:

light-emitting means coupled to an upper end of a pin pole and configured to identify a pin position, the light-emitting means including a wireless transmit/receive portion and a unique ID; and a remote control unit that remotely controls lighting and lights-out of the light-emitting means for identifying the pin position in a wireless manner, wherein the remote control unit comprises:

a wireless transmit/receive portion;

a batch registration key for batchly registering a plurality of light-emitting means;

a selective registration key for selectively registering the light-emitting means;

a control object-setting portion that selects light-emitting means to be controlled;

an execution button that instructs the lighting and lights-out of the light-emitting means; and a remote controller which controls a unique ID of the light-emitting means to be controlled, which is wirelessly received through scanning in a registration mode, to be registered in an internal memory by matching the unique ID to a remote control object ID of the control object-setting portion, and wirelessly transmits a lighting and lights-out command to light-emitting means having a unique ID, which matches to the remote control object ID registered in the internal memory, through the wireless transmit/receive portion when an execution button is pressed, wherein when the registration mode is operated through the batch registration key, the remote controller scans unique IDs of the plurality of light-emitting means to be registered, matches remote control object IDs to the scanned unique IDs on a basis of unique ID values, and registers matched IDs in the internal memory; and wherein when the registration mode is operated through the selective registration key, the remote controller scans a unique ID of the light-emitting means to be registered, matches a remote control object ID selected by a user to the scanned unique ID, and registers matched IDs in the internal memory.

2. The apparatus of claim 1, wherein the light-emitting means for identifying the pin position comprises surface mounted device light emission diodes, a solar cell, and a push button.

3. A method of registering light-emitting means in an apparatus for identifying a pin position on a golf course, wherein the apparatus includes light-emitting means coupled to an upper end of a pin pole and configured to identify a pin position, the light-emitting means having a wireless transmit/receive portion and a unique ID, and a remote control unit that remotely controls lighting and lights-out of the light-emitting means for identifying the pin position in a wireless manner, the method comprising the steps of:

providing a batch registration key for batchly registering a plurality of light-emitting means;

providing a selective registration key for selectively registering the light emitting means;

scanning a unique ID of the light-emitting means through a wireless transmission and reception when a registration key of the remote control unit is pressed;

controlling the scanned unique ID of the light-emitting means to be registered in an internal memory by matching the scanned unique ID to a remote control object ID selected by a control object-setting portion of the remote control unit; and wirelessly controlling light-emitting means, corresponding to the registered remote control object ID, to be lightened and lightened out, wherein when the registration key is a batch registration key, the remote control unit scans unique IDs of a plurality of light-emitting means to be registered, matches remote control object IDs to the scanned unique IDs on a basis of unique ID values, and registers matched IDs in the internal memory; and wherein when the registration key is a selective registration key, the remote control unit matches a remote control object ID selected by a user to the scanned unique ID, and registers matched IDs in the internal memory.

* * * * *